United States Patent [19]

Hettlage et al.

[11] Patent Number: 4,945,320

[45] Date of Patent: Jul. 31, 1990

[54] MICROWAVE SWITCH HAVING AT LEAST TWO SWITCHING POSITIONS

[75] Inventors: Eckart Hettlage, Karlsruhe; Gerd Ruff, Heidelberg, both of Fed. Rep. of Germany

[73] Assignee: Teldix GmbH, Heidelberg, Fed. Rep. of Germany

[21] Appl. No.: 264,954

[22] PCT Filed: Feb. 17, 1987

[86] PCT No.: PCT/EP87/00089

§ 371 Date: Aug. 18, 1988

§ 102(e) Date: Aug. 18, 1988

[87] PCT Pub. No.: WO87/05155

PCT Pub. Date: Aug. 27, 1987

[30] Foreign Application Priority Data

Feb. 18, 1986 [DE] Fed. Rep. of Germany ..... 3605043

[51] Int. Cl.[5] ..... H01P 1/10

[52] U.S. Cl. ..... 333/106; 333/108

[58] Field of Search ..... 333/105–108; 200/504, 564, 566, 570

[56] References Cited

U.S. PATENT DOCUMENTS

| | | | |
|---|---|---|---|
| 4,201,963 | 5/1980 | Welti | 333/106 |
| 4,463,324 | 7/1984 | Rolfs | 333/26 |
| 4,761,622 | 8/1988 | Cracknell et al. | 333/108 X |

*Primary Examiner*—Paul Gensler

*Attorney, Agent, or Firm*—Spencer & Frank

[57] ABSTRACT

A waveguide switch selectively connects at least one coaxial input line with at least one of two output lines of which at least one is a coaxial line. The waveguide switch includes a rotor having at least one rectangular waveguide passage which has a height which is relatively small, as well as a housing for rotatably supporting the rotor. The housing has a plurality of waveguide sections, each of the waveguide sections have substantially the same cross-sectional dimensions, and which are connectable with one another by the waveguide passage in the rotor by rotation of the rotor. At least one of the plurality of waveguide sections has an adapter for connection to at least one of the coaxial input line and at least one of the two output lines.

10 Claims, 4 Drawing Sheets

MICROWAVE SWITCH HAVING AT LEAST TWO SWITCHING POSITIONS

BACKGROUND OF THE INVENTION

The invention relates to a microwave switch which can be set into at least two different switching positions for the selective connection of at least one coaxial input line with at least one of two output lines of which at least one is a coaxial line. The switch serves to switch HF signals.

DE-OS No. 3,122,780 discloses a coaxial T switch which has three transmission positions between pairs of four plug-in connectors, with the switching elements being provided in the form of planar line segments which either lie against the walls of cavities or are arranged in the center of cavities. If a line segment lies against the wall of a cavity, it is short-circuited toward the cavity and is separated from the inner conductors of the coaxial connector. If the line segment is disposed in the center of the cavity, the ends of the line segment are also in contact with the inner conductors of the coaxial connector since the inner conductors of the coaxial connector are disposed in juxtaposition to the ends of the line segment.

A cavity is disposed in a certain plane and is configured in the form of a plurality of cavity sections. In particular, the cavity has an outer, circumferential portion which is subdivided into three outer cavity sections. Three radial cavity sections begin at a central point of the circumferential portion and intersect the ends of the three outer cavity sections. A first coaxial connector is disposed at the central location, while three additional coaxial connectors are disposed at the points of intersection between the radial cavity sections and the outer cavity sections. A single line segment is disposed in each cavity section and is movable between a position at the wall of the cavity and remote from the inner conductors and a central position in the cavity section where it is in contact with the inner conductors. The total of six line segments correspond in number and shape to the cavity sections so that three line segments extend radially outwardly beginning at a central location while three line segments are arranged around the three radial line segments in such a manner that they form a circumferential segment.

The various line segments can be actuated individually so that signals can be transmitted between pairs of coaxial connectors.

It has been found that the prior art coaxial switches, due to their existing mechanical contacts, are less reliable and have relatively poor high frequency characteristics. Moreover, if a plurality of such switches are connected in series, e.g. if they are employed in redundant amplifier circuits as they are used in space travel, the transmission characteristics of the signals conducted through a plurality of such switches become very poor.

SUMMARY OF THE INVENTION

It is therefore an object of the invention to improve a microwave switch of the aforementioned type so that good transmission characteristics are realized over a relatively large transmission bandwidth and having a low weight and small dimensions; this also makes possible a series connection of a plurality of switches with still satisfactory transmission characteristics.

This is accomplished according to the invention having an internal waveguide switch having at least one rectangular waveguide passage in the rotor of the switch selectively connectable with waveguide sections in the housing of the switch. In this solution, the internal transmission within the microwave switch is effected by means of a waveguide. Due to the waveguide passages provided in the microwave switch, it is possible to realize a relatively wide transmission bandwidth with good transmission characteristics.

Waveguide switches per se are known, for example from DE-OS No. 2,924,969. Adapters for coupling coaxial lines to waveguides and vice versa are also known in the art (DE-AS No. 2,336,166). Since the standard waveguide dimensions customary for carrying the frequencies to be transmitted would lead to very large and heavy waveguide switches, the person skilled in the art will not attempt to solve the problem at hand by considering waveguide switches.

An additional reduction in weight and volume with a simultaneous increase in switching possibilities is provided by a further embodiment of the internal waveguide switch. In this internal waveguide switch, four waveguides are arranged in three planes within the rotor with their small dimensions parallel to the rotor axis.

A special arrangement of the adapters—a coaxial input connector is inserted parallel to the switch axis from one side and the coaxial output connector is inserted parallel to the switch axis from the other side—permits a straight arrangement of the transmission lines without many bends so that the total cabling system becomes short and light-weight.

A further advantage of the further configuration of the microwave switch results from the possibility of either connecting the waveguide ports of the internal waveguide switch directly with one another or via special waveguides having corresponding cross-sectional dimensions to thus realize improved transmission characteristics for the entire circuit and a saving in weight for the entire circuit.

BRIEF DESCRIPTION OF THE DRAWINGS

The invention will now be described in greater detail with reference to embodiments which are illustrated in the drawings.

DETAILED DESCRIPTION OF THE PREFERRED EMBODIMENTS

Figure 1:
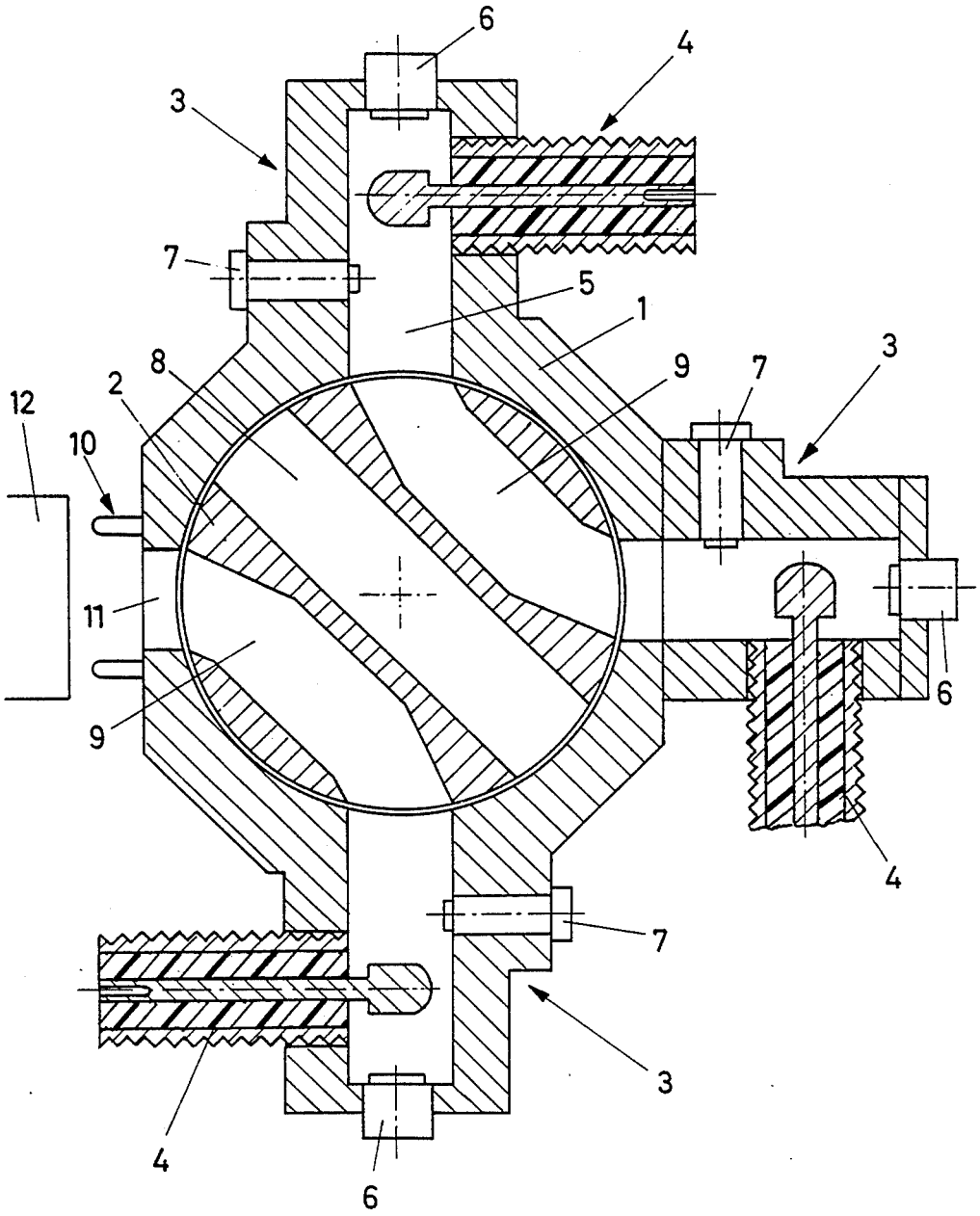
FIG. 1 is a schematic representation in a sectional view perpendicular to the axis of rotation, of the structure of a microwave switch according to the invention.

The microwave switch according to FIG. 1 includes a rotor 2 rotatably mounted in a housing 1. Between the housing 1 and the rotor 2 there is disposed a small air gap.

Two adapters 3 (for coupling to waveguide ports) are integrated in the housing 1, and a third adapter is connected on the right of it, and is screwed on. HF signals are coupled into the waveguide passages of each of the adapters 3 (only one of which is numbered in FIG. 1) in a generally known manner which will not be described in detail here. So-called tuning screws 6 and 7 are provided at each of the adapters 3 to set the transmission characteristics. Coaxial ports 4 each extend at a right angle to the waveguide sections 5 the adapters 3. This arrangement is appropriate in order to save space. The housing 1 is connected to a connecting member 12 at the location of a waveguide opening 11 in the housing 1. This connecting member 12 performs two functions: to permit measurement of the transmission characteristics of the microwave switch and to provide a connection the coaxial ports or conductors 4 via the waveguide passages 8 and 9 of the internal waveguide switch to a measuring instrument or device additionally, if the microwave switch is used in a redundant system, a further waveguide, likewise having reduced cross-sectional dimensions and leading to the next waveguide switch, may be coupled in at the connecting member 12. This has the advantage that adapters can be omitted and thus, due to the elimination of the adapters, the transmission characteristics of the entire circuit are improved.

For the waveguide passage 9 having walls of small crosssectional dimensions the walls may be composed of a plurality of sheet-like pieces.

Figure 2:
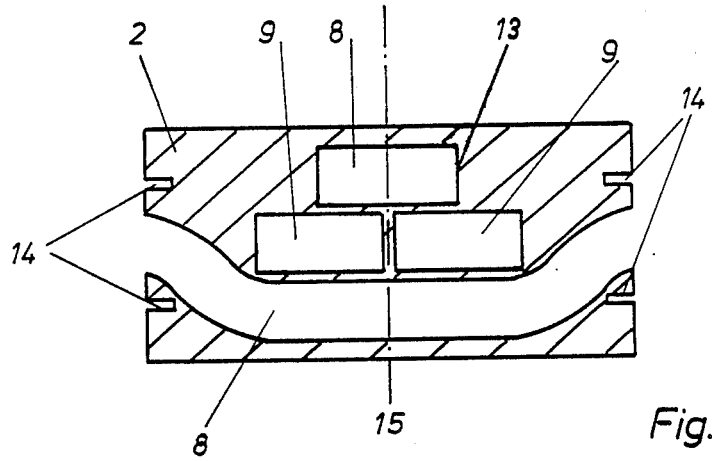
FIG. 2 is a schematic representation, in a vertical sectional view, of the structure of a rotor of an internal waveguide switch according to a further embodiment.

FIG. 2 is a vertical sectional view parallel to the rotor axis of the structure of a rotor 2 according to a further embodiment of an internal waveguide switch. Because of the waveguide passages 8, 9, having a relatively small thickness 13 in a direction which is parallel to the rotor axis, a very flat rotor 2 is created which is mounted so as to be rotatable through an angle of 360° about the rotor axis. The rotor 2 includes four waveguide passages 8, 9 for the connection of various waveguide sections (having a structure corresponding to that of the waveguide sections 5 of FIG. 1) of the waveguide switch in various switching positions. Two of these internal waveguide passages 8 serve the purpose of interconnecting oppositely disposed ones of the waveguide sections 5. The other two waveguide passages 9 connect adjacent ones of the waveguide sections passages 5 with one another. The waveguide passages 8 which connect oppositely disposed waveguide sections 5 with one another are angled in the vicinity of the edge of the rotor 2, avoiding sharp angles, and in the manner are each brought past the arcuate waveguide passages 9 in different planes. Chokes 14 disposed at the periphery of the rotor 2 serve to reduce crosstalk.

Figure 3:
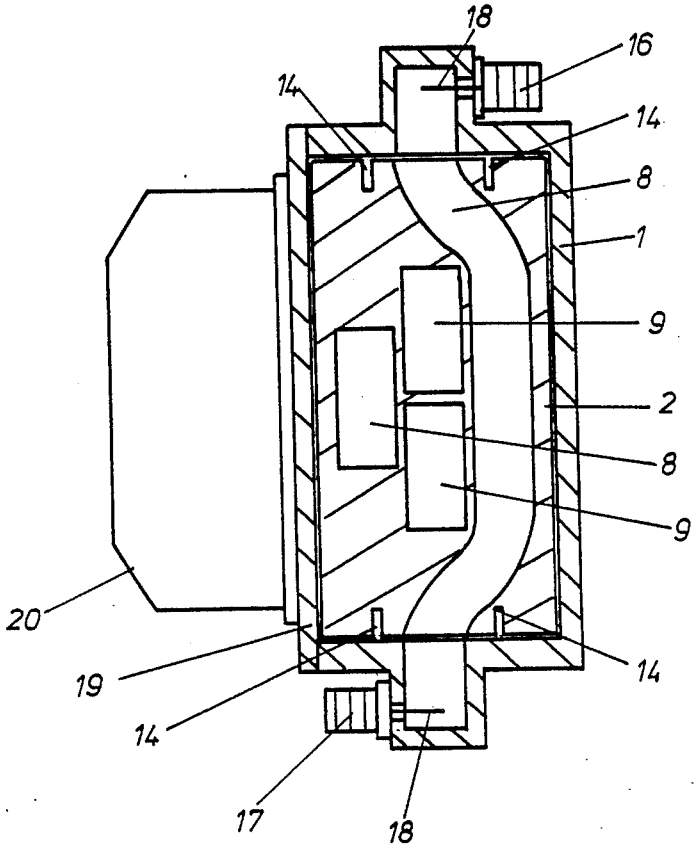
FIG. 3 is a schematic representation, in a vertical sectional view, of the structure of the microwave switch standing, and including a rotor according to FIG. 2.

FIG. 3 is a vertical sectional view parallel to the rotor axis of a microwave switch according to the further embodiment of FIG. 2, with the switch in a standing position and including a drive element 20. The drive element 20, for example a stepping motor, is mounted on the housing cover 19 of the microwave switch. One adapter (unnumber) is integrated in the top and one in the bottom of the housing 1 as seen in FIG. 1 respectively includes coaxial connectors 16, 17 which each have a coaxial inner conductor 18. For example, in the overall cabling system, the coaxial input line and the coaxial output line may be brought to the coaxial connectors 16, 17 of the microwave switch from opposite sides. The rotor 2 and its bearing (not shown) as well as the waveguide passages 8, 9 are disposed in the housing 1 of the microwave switch.

Figure 4:
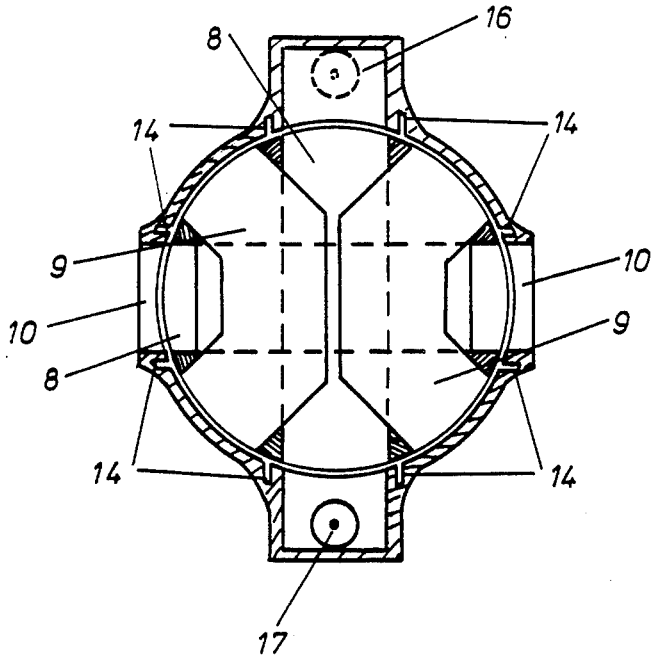
FIG. 4 is a schematic representation, in a horizontal sectional view, of the structure of the microwave switch according to FIG. 3.

FIG. 4 is a horizontal sectional view taken perpendicularly to the rotor axis of a microwave switch of the further embodiment. By way of special waveguides having reduced cross-sectional dimensions, direct connections can be established, via two flanges 10, from one internal waveguide switch (not shown) to another internal waveguide switch, or alternatively waveguide switches of the further embodiment can be directly coupled together. In the case where redundancy is to be provided the above-described features of the further embodiment frequently obviate the need for transitions between a coaxial line and a waveguide or a waveguide and a coaxial line in the redundant path, and the transmission characteristics of the redundant path are not significantly worsened. Here, too, the walls of arcuate waveguide sections 9 are made of a plurality of sheet-like pieces.

Figure 5:
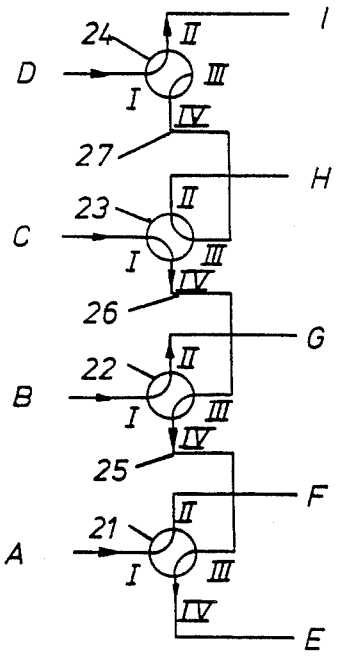
FIG. 5 is a redundant circuit including two-way microwave switches according to the invention.

FIG. 5 shows the use of two-way microwave switches 21 to 24 according to the invention in a redundant system, with the signals arriving on four coaxial lines A–D and leaving through four (of a total of five) coaxial lines F–I which can be connected by way of four two-way switches 21–24 (S switches) which are configured internally as waveguide switches and which each have four ports labelled I–IV. Connections 25–27 from each of the microwave switches 22, 23, and 24, respectively, to microwave switches 21, 22, and 23, and these connections 25–27 are either configured to have special waveguides or the microwave switches are connected with one another directly at their flanges 10. The multiple coaxial conductors and their transitions existing in the coaxial switches according to the invention in the case of the redundant circuit described above eliminates the strong attenuation of the signal carried over the path of the redundant circuit. Ports I and II of the two-way switches 21–24 and also the port IV of the microwave switch 21 are provided with adapters 3 for the connection of coaxial lines. Ports III and IV are provided with flanges 10 for the connection of special waveguides. Switch 24 is terminated at port III.

The signals are fed to coaxial ports I of the switches via coaxial lines A–D. In the normal case, i.e. if all channels are operational, switches 21–24 are in such a position that the HF signals are carried through coaxial ports II and coaxial lines F–I to the subsequent amplifiers. The amplifier connected with coaxial line E at port IV of switch 21 is not in operation in the normal case. For the case where, for example, the amplifier connected to coaxial line H at port II of switch 23 is malfunctioning, switch 23 is switched in such a way that the signal in coaxial line C at input I of switch 23 is conducted, via the flange 10 at port IV to the special waveguide 26, the flanges 10 at ports III and IV of switch 22, the special waveguide 25,the flange 10 at port III of switch 21, and the adapter 3 at port IV of the switch 21, and from there the signal is connected with an operational amplifier connected with the coaxial line E. Even in the case where a redundant circuit is used the signal arriving in coaxial line C has only one coaxial line/waveguide transition and only one waveguide/coaxial line transition. With a purely coaxial switch, the signal would be attenuated considerably because of the required six coaxial line/coaxial line transitions.

Figure 6:
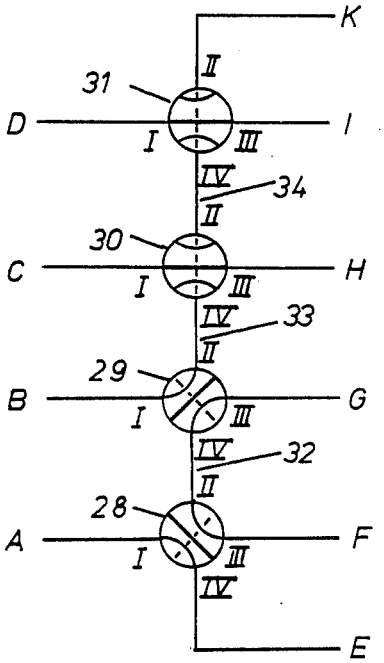
FIG. 6 is a redundant circuit including four-way microwave switches according to the invention.

FIG. 6 shows the use of four-way microwave switches 28–31 according to the invention in a redundant system where the signals arriving on four coaxial lines A-D and leaving on four of the six coaxial lines can be switched by means of four four-way switches 28–31 arranged as (T-switches) which are internally configured as waveguide switches and which each have four ports. Here again the connections from switch to switch are provided either to include special waveguides or the switches are directly connected with one another at their flanges 10. At their ports I and III, the four-way switches 28–31 are provided with adapters 3, while switches 28 and 31 are also provided with coaxial ports at ports IV and II, for the connection of coaxial lines. The ports II of the switches 28–30 and ports IV of switches 29–31 are provided with flanges 10 for the connection of special waveguides or for the direct connection of the internal waveguide switches with one another. Here again the signals are fed to the coaxial ports I of switches 28–31 via coaxial lines A–D.

In the normal case, i.e. if all channels are operational, switches 28–31 are in such positions that the HF signals travel via respective coaxial ports III and respective coaxial lines F–I to amplifiers connected to the lines F–I. The amplifiers connected with coaxial lines E and K of switches 28 and 31 are not in operation in the normal case. For the case where, for example, the two amplifiers connected to coaxial lines F and G are malfunctioning, the two switches 28 and 29 are switched in such a manner that the signal on coaxial line A at input I of switch 28 is fed, via adapter 3 at port IV and coaxial line E, to the next following amplifier. The signal on coaxial line B at port I of switch 29 is conducted via the flange 10 at port II, the special waveguide 33, the flange 10 at port IV of switch 30, the flange 10 at port II, the special waveguide 34, the flange 10 at port IV of switch 31, and the adapter at port II to the coaxial line K, which conducts the signal to the subsequent amplifier. Here again, in the case of redundancy, the signals in lines A and B have only one coaxial line/waveguide and waveguide/coaxial line transition and are thus not attenuated as much as in a circuit having purely coaxial switches.

The special configuration of the waveguide passages in the switches and the special waveguide between the switches has the significance that the dimensions of the switches are selected to be smaller than to the standard waveguide dimensions customary for the frequencies to be transmitted. Preferably, the small dimensions are made very much smaller. For example, for 10 to 15 GHz, instead of a height dimension of 9.5 mm and a width of 19 mm, waveguides are selected which have a 4.75 mm height dimension and are 19 mm wide.

We claim:

1. A waveguide switch for the selective connection of at least one coaxial input line with at least one of two output lines of which at least one is a coaxial line, comprising:

a rotor including at least one rectangular waveguide passage for conducting microwave frequencies to be transmitted, said at least one waveguide passage in said rotor having a height which is small compared with a standard waveguide for said microwave frequencies to be transmitted; a housing for rotatably supporting said rotor, said housing having a plurality of waveguide sections, each of said waveguide sections having substantially the same cross-sectional dimensions as said at least one waveguide passage; said waveguide sections of said housing being connectable with one another by said at least one waveguide passage by rotation of said rotor; and at least two of said plurality of waveguide sections each having an adapter for connection respectively to said coaxial input line and to said coaxial output line.

2. A waveguide switch according to claim 1, wherein said housing has four waveguide sections of mutually identical cross-sectional dimensions and which are radially disposed in one plane spaced at 90° angles; said rotor includes at least one waveguide passage which can connect two radially opposite ones of said four waveguide sections with each other, and said rotor includes two further waveguide passages which are configured as 90° angled waveguide sections which can connect adjacent ones of said plurality of waveguide sections with each other.

3. A waveguide switch according to claim 2, wherein at least another one of said plurality of waveguide sections in said housing includes an adapter for connection to one of a coaxial input line and a coaxial output line, and wherein said at least another one of said plurality of waveguide sections which is radially oppositely disposed from said at least one waveguide section has said adapter.

4. A waveguide switch according to claim 3, wherein at least one of said plurality of waveguide sections is configured to be directly coupled to a separate waveguide having the same cross-sectional dimensions.

5. A waveguide switch according to claim 4, wherein said separate waveguide to be coupled to said at least one of said plurality of waveguide sections is a waveguide section on a stator side of a further internal waveguide switch.

6. A waveguide switch according to claim 1, wherein said height of each of said plurality of waveguide sections and of said at least one waveguide passage are oriented parallel to a rotational axis of said rotor.

7. A waveguide switch according to claim 2, wherein said two further waveguide passages configured as angled waveguide sections are disposed in a first plane and, when said rotor includes only one said waveguide passage for the interconnection of oppositely disposed ones of said plurality of waveguide sections, said waveguide passage in said rotor is bent in the vicinity of the edge of said rotor and extends past said arcuate waveguide sections in a second plane.

8. A waveguide switch according to claim 2, wherein said two further waveguide passages configured as angled waveguide sections are disposed in a first plane and, when said rotor includes two waveguide passages for connection of oppositely disposed waveguide sections with each other, said two waveguide passages in said rotor are bent in the vicinity of the edge of said rotor and extend past said arcuate waveguide sections in second and third planes.

9. A waveguide switch according to claim 1, wherein the coaxial input line is connected to one side of said housing such that it is oriented in a direction which is parallel to the axis of said rotor, and the coaxial output line is connected to an opposite side of said housing such that it is oriented in a direction which is parallel to the axis of said rotor.

10. A circuit arrangement for connection of a plurality of n waveguide switches for the selective connection of n coaxial input lines to n of (n+a) coaxial output lines, where a has the value of 1 or 2, comprising:

said plurality of n microwave switches each having an input port and a plurality of output ports, said plurality of n microwave switches being connected sequentially by coaxial cables;

the second to (n−1)th microwave switch in the sequence including two waveguide output ports, at least one of the first and the nth microwave switch in said sequence each have two coaxial output ports as well as one waveguide output port; said coaxial output ports are each coupled to a respective coaxial output line and each said waveguide port is connected with a waveguide port of an adjacent one of said plurality n of microwave switches; and the n input lines are switched to chosen ones of said n output lines by switching at least one of said plurality of n microwave switches; and each of said plurality n of said microwave switches having a housing and a rotor rotatably disposed in said housing, said rotor having at least one waveguide passage which has a height which is small relative to the standard waveguide at the frequencies to be transmitted said housing having a plurality of waveguide sections connected respectively to said input port, said output ports, and said waveguide port, and each of said waveguide sections have substantially the same cross-sectional dimensions as said at least one waveguide passage; said waveguide sections of said plurality of n microwave switches are connectable with one another by rotation of said rotor; and respective ones of said plurality of waveguide sections of said plurality of n microwave switches include an adapter for connection to said coaxial input line and to said two output lines.

* * * * *